US009057385B2

(12) United States Patent
Burgess et al.

(10) Patent No.: US 9,057,385 B2
(45) **Date of Patent: *Jun. 16, 2015**

(54) PUMP CASING

(71) Applicant: Weir Minerals Australia Ltd., Artarmon, NSW (AU)

(72) Inventors: Kevin Edward Burgess, Carlingford (AU); Wen-Jie Liu, Eastwood (AU); Luis Moscoso Lavagna, North Ryde (AU); Garry Bruce Glaves, Marsfield (AU)

(73) Assignee: Weir Minerals Australia Ltd. (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/289,553

(22) Filed: May 28, 2014

(65) Prior Publication Data

US 2014/0271159 A1 Sep. 18, 2014

Related U.S. Application Data

(63) Continuation of application No. 12/737,039, filed as application No. PCT/AU2009/000714 on Jun. 5, 2009, now Pat. No. 8,747,062.

(30) Foreign Application Priority Data

Jun. 6, 2008 (AU) ..... 2008902886
Aug. 14, 2008 (AU) ..... 2008904163

(51) Int. Cl.
*F04D 29/42* (2006.01)
*F04D 29/44* (2006.01)
*F04D 7/04* (2006.01)

(52) U.S. Cl.
CPC ..... *F04D 29/4286* (2013.01); *F04D 29/428* (2013.01); *F04D 7/04* (2013.01)

(58) Field of Classification Search
CPC ..... F04D 29/4286; F04D 29/428; F04D 7/04
USPC ..... 415/196, 197, 204, 206, 211.1, 214.1; 29/888.021, 888.024
See application file for complete search history.

(56) References Cited

U.S. PATENT DOCUMENTS 1,163,778 A 12/1915 Scheurmann
1,197,653 A 9/1916 Norton (Continued)

FOREIGN PATENT DOCUMENTS

AU 104771 S 8/1989
AU 104772 S 8/1989

(Continued)

*Primary Examiner* — Christopher Verdier
(74) *Attorney, Agent, or Firm* — Morriss O'Bryant Compagni

(57) ABSTRACT

A pump casing for a centrifugal pump, which comprises an inlet opening, a discharge outlet, and a transition surface extending between an inner peripheral surface of the main pumping chamber and an inner peripheral surface of the discharge outlet, the transition surface arranged for separating an in use exit flow of material in the discharge outlet from an in use recirculation flow of material in the main pumping chamber. The transition surface has a cutwater having a profiled section which comprises a protrusion which extends irregularly from an otherwise generally rounded arched or U-shaped transition surface and is configured such that, in use, the velocity and/or turbulence resulting from the in use flow of the material being pumped in the main pumping chamber is reduced.

7 Claims, 17 Drawing Sheets

(56) References Cited

U.S. PATENT DOCUMENTS

| | | | | | |
|---|---|---|---|---|---|
| 1,989,061 | A | * | 1/1935 | Longenecker | 415/211.1 |
| 2,992,617 | A | | 7/1961 | Kroeger | |
| 3,265,002 | A | | 8/1966 | Warman | |
| 3,319,573 | A | | 5/1967 | Judd | |
| 4,076,450 | A | * | 2/1978 | Ross | 415/197 |
| 4,844,693 | A | | 7/1989 | Grzina | |
| 4,872,809 | A | | 10/1989 | Addie et al. | |
| 4,917,571 | A | | 4/1990 | Hyll et al. | |
| 4,974,998 | A | * | 12/1990 | Heineman | 406/97 |
| 5,228,831 | A | * | 7/1993 | Becker | 415/206 |
| D368,913 | S | | 4/1996 | Wightley | |
| D381,339 | S | | 7/1997 | Wightley | |
| 5,779,444 | A | | 7/1998 | Onigata et al. | |
| 6,988,870 | B2 | | 1/2006 | Walker | |
| D545,326 | S | | 6/2007 | Zellers | |
| 8,747,062 | B2 | * | 6/2014 | Burgess et al. | 415/197 |
| 2004/0126228 | A1 | | 7/2004 | Roudnev et al. | |
| 2007/0014662 | A1 | * | 1/2007 | Burgess | 415/197 |

FOREIGN PATENT DOCUMENTS

| | | | |
|---|---|---|---|
| AU | 104773 | S | 8/1989 |
| EP | 0648939 | A2 | 4/1995 |
| GB | 14668 | A | 0/1912 |
| WO | 2007073210 | A1 | 6/2007 |

* cited by examiner

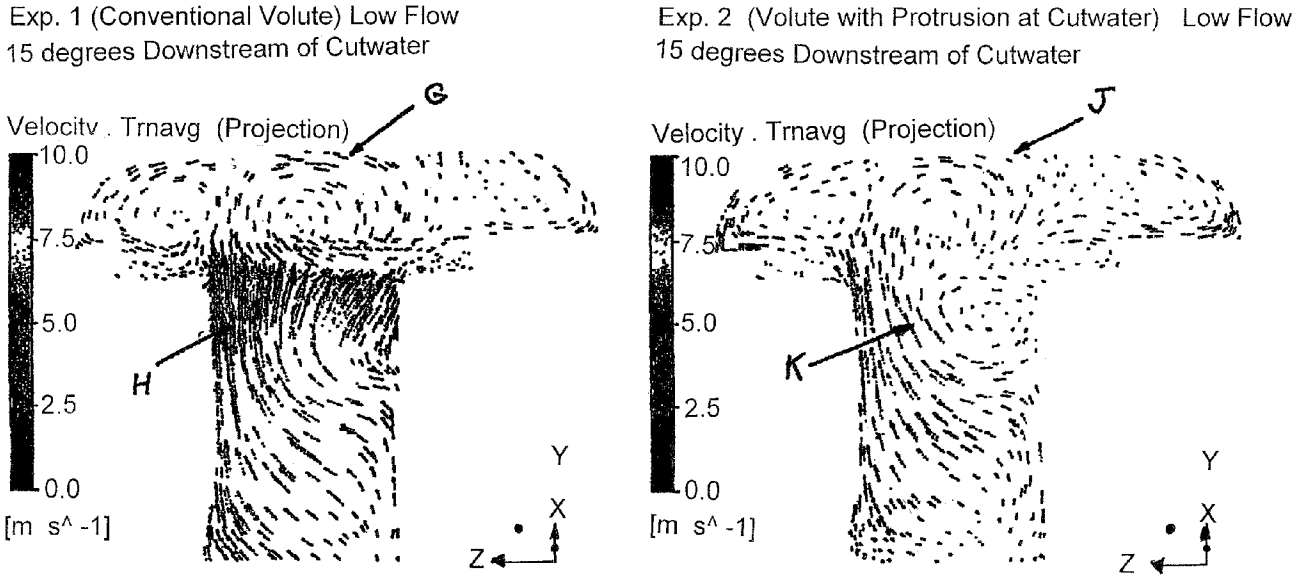
FIG.11
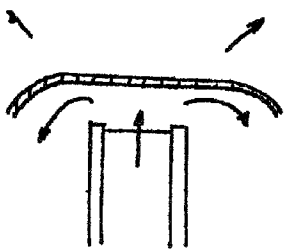
FIG.12
FIG. 11(A)

PUMP CASING

CROSS-REFERENCE TO RELATED APPLICATIONS

This application is a continuation of U.S. Ser. No. 12/737,039, filed Feb. 21, 2011, now issued as U.S. Pat. No. 8,747,062, which claims priority to International Application No. PCT/AU2009/000714, which claims priority to Australian Application No. 2008902886, filed Jun. 6, 2008, and to Australian Application No. 2008904163, filed Aug. 14, 2008, the entire contents of each of which are incorporated herein by reference.

BACKGROUND OF THE INVENTION

1. Technical Field

This disclosure relates generally to pumps and more particularly though not exclusively to centrifugal pumps for handling slurries.

2. Background Art

Centrifugal slurry pumps typically comprise a casing with a pumping chamber therein in which is disposed an impeller mounted for rotation on an impeller shaft. The impeller shaft enters the pumping chamber from the rear side, or drive side, of the pump housing. A discharge outlet extends tangentially from the periphery of the pump housing and provides for the discharge of fluid from the pump chamber.

One form of conventional pump casing for a centrifugal pump is illustrated in FIGS. 1 to 4. FIGS. 1 and 2 are perspective illustrations of the pump casing shown from slightly different front side angles. FIG. 3 is a sectional side elevation of the casing and FIG. 4 is a sectional view along the line X-X of FIG. 3.

The pump casing 10 includes a peripheral wall portion 12 having a pumping chamber 14 therein and opposed sides 15 and 16 (FIG. 4). During use, an impeller is mounted for rotation within the pump casing. An inlet opening to the pumping chamber 14 is provided on one side of the casing and a drive shaft to which the impeller is mounted extends through the other side. The pumping chamber 14 in the region of the peripheral wall portion 12 is of a volute shape, offset circular shape or any other suitable shape. A discharge outlet 13 extending from the peripheral wall portion 14, there being a cutwater 19 which in use generally serves to divide the discharge outlet flow from the pumping chamber recirculation flow.

In other forms of centrifugal pumps an outer housing may be provided which encases the pump casing which is shown in FIGS. 1 to 4. Throughout this specification when the term "pump casing" is used, it refers to a chamber which surrounds a pump impeller and in which the impeller can rotate in use. In unlined pumps, the "pump casing" also is the exterior casing of the pump. In a lined pump, the "pump casing" can be a lining or liner (also known as a volute), which is itself surrounded by an exterior casing structure. Unlined pumps typically find application in low wear situations, for example in use to pump liquids or non-abrasive solid-liquid mixtures. In lined pumps, the liner or volute is a wear part which is exposed to the movement of an abrasive slurry during use, and which eventually requires replacement, and the exterior casing or shell of the pump remains undamaged.

The pump casing may be formed from hard metal such as a white iron, or an elastomeric material, such as rubber. The pump casing may further include side liners mounted at respective sides 15, 16 of the pump casing 10. As is best seen in FIG. 4, in a conventional pump casing the cutwater 19 is arch shaped, having transition zones 17 in the form of tapering blend sections extending from the ends of the arch-shaped cutwater between the discharge outlet 13 and the pumping chamber 14, in the region of the peripheral wall portion 12. The cutwater 19 is that part of the casing which is the closest to the outer periphery of the impeller, the function of which is to assist the distribution of fluid flow into the discharge outlet 13 and to minimise the recirculation around the circumferential region of the pumping chamber (that is, the region between the inner surface of the peripheral wall portion 12 and the outer circumference of an impeller when located within the pumping chamber).

In use, a centrifugal slurry pump is required to operate over a wider range of flows and pressure heads during its normal operation, and may even be driven via a variable speed drive to achieve a wide operational range of flow and pressure. Depending on the pump speed, the slurry flow and particles which exit the rotating impeller into the volute region will either exit the volute into the discharge outlet (flow B in FIG. 3) or the flow and particles will recirculate around the volute (flow A in FIG. 3). The best efficiency point (BEP) of a centrifugal slurry pump is defined as the flow that produces the highest operational efficiency at one particular rotational speed. At the BEP the amount of recirculation around the volute (flow A) is minimal as the flow approaching the cutwater is at the correct flow angle relative to the cutwater, such that the cutwater divides the flow more uniformly with smooth streamlines on either side of the cutwater.

Centrifugal slurry pumps are typically not used in mining application at flows higher than the BEP flow, due to the accelerated erosive wear of the components which may occur. Instead, a centrifugal slurry pump is selected such that the flow is between 30 and 100% of the BEP flow at any one operating speed. Under these operating conditions, the degree of recirculation (flow A) around the volute can increase, which can also cause more turbulence within the volute, particularly at the cutwater region of the volute. Since the flow approaching the cutwater is more turbulent, the velocity will not be uniform, nor have a smooth flow to match the cutwater angle.

The recirculating flow in the volute is influenced by the cutwater 19 and also by the transition zones 17 shown in FIGS. 3 and 4. With an arch shaped transition region, in operation it is possible that two large swirling flow vortex patterns will be created on either side of the volute which then interact at the cutwater region, and then further downstream of the cutwater region at generally around the centreline of the volute. These vortex flows can result in the slurry particles having a higher energy and velocity, resulting in wear and erosion of the material in and around the cutwater region because this region is closest to the impeller and also is the dividing point for the flows A and B.

As mentioned earlier, centrifugal slurry pumps may, in one form typically comprise an outer casing with an internal liner moulded from a wear resisting elastomer compound. In this form, both the outer casing and the liner are traditionally manufactured in two parts or halves which are held together with bolts positioned at the external periphery of the casing. The two parts join along a plane which is generally perpendicular to the axis of rotation of the pump impeller.

When assembled, the two parts form a housing having a front side with an inlet therein and a rear side, the two parts defining a pumping chamber therein in which is disposed an impeller mounted for rotation on an impeller shaft. In some embodiments the impeller shaft enters the pumping chamber from the rear side and an outlet is provided at a peripheral side edge or wall portion of the housing.

As described earlier, the cutwater separates the flow circulating in the pumping chamber from the flow discharging through the outlet. The flow can have pressure fluctuations imposed on it as a result of the impeller pumping vanes passing the cutwater as the impeller rotates. The cutwater has unequal pressure distribution on its opposing sides due to the nature of the flow. Pressure pulses can cause the rubber to vibrate which results in fretting on the contact surfaces of the rubber liners and/or of the rubber inside the pump casing. Vibration in rubber also causes hysteresis losses within the rubber which can lead to breakdown of the rubber and a reduction in its strength due to a build-up of temperature from the losses.

SUMMARY OF THE DISCLOSURE

In a first aspect, embodiments are disclosed of a pump casing for a centrifugal pump, the pump casing including a main pumping chamber having:

- an inlet opening arranged for the introduction of a flow of material into the main pumping chamber during use;
- a discharge outlet extending from the main pumping chamber and arranged for the exit of a flow of material from the main pumping chamber during use; and
- a transition surface extending between an inner peripheral surface of the main pumping chamber and an inner peripheral surface of the discharge outlet, the transition surface arranged for separating an in use exit flow of material in the discharge outlet from an in use recirculation flow of material in the main pumping chamber;

wherein the transition surface has a cutwater having a profiled section which comprises a protrusion which extends irregularly from an otherwise generally rounded, arched or U-shaped transition surface and is configured such that, in use, the velocity and/or turbulence resulting from the in use flow of the material being pumped in the main pumping chamber is reduced.

Such a configuration of the transition surface can reduce the incidence of swirling flow vortex patterns on either side of the volute, resulting in a reduction in the wear and erosion of the material in and around the cutwater region. The reduction of such flows has the advantage of retarding the development of conditions which can result in poorer pumping performance.

The cutwater is arranged to distribute the flow into the discharge outlet and to reduce the recirculation flow of material into the main pumping chamber. In some embodiments, the transition surface may also include at least one blend or transition region to provide a smooth taper between the cutwater and the said inner peripheral surfaces of the main pumping chamber and the discharge outlet.

In some embodiments, the protrusion itself may, for example, have generally rounded edges. The protrusion may, for example, have a bump shape or a dimple shape, or a tongue-like shape, although other shapes which achieve the desired operating flow regime are possible. In some embodiments, the protrusion may extend into the discharge outlet itself.

In some embodiments, the main pumping chamber can comprise two opposing side wall portions and the protrusion is disposed generally centrally between the said side wall portions. In some embodiments, and depending upon the circumstances of the particular application, the protrusion may not be generally centrally located, but can be off-center or arranged to extend from one of the side wall portions.

In some embodiments, the protrusion may be of an elastomeric, metallic or any other suitable material which provides suitable wear resistance characteristics.

In some embodiments, a protrusion can be retrofitted to the transition surface of a prior art pump casing to form the profiled section, by using any appropriate fixing or joining technique.

In some embodiments, the main pumping chamber may be of a generally volute shape. In one embodiment, the pump casing can be in the form of a liner for a pump having an outer housing.

In some embodiments, the pump casing comprises two side parts which can be fitted together so as to form the pump casing wherein each of the side parts comprises a part of the main pumping chamber, the discharge outlet and the cutwater and wherein each part of said cutwater has reinforcement associated therewith.

In some embodiments, the reinforcement includes a projection on one of the parts of the cutwater and a co-operating recess on the other of the parts of the cutwater, the projection being receivable within the recess when the side parts are fitted together.

In some embodiments, the cutwater includes a leading edge, said reinforcement being spaced from the leading edge of the cutwater.

In some embodiments, the projection extends into the recess when fitted sufficiently to account for any wear of the casing when in use. In some embodiments, the reinforcement is spaced from the inner peripheral surface of the pumping chamber and is also spaced from the inner peripheral surface of the discharge outlet.

In some embodiments, the recess and the projection are generally rectangular when viewed in cross-section having a longitudinal axis extending in the direction of the cutwater.

In some embodiments, the reinforcement includes a recess in each part of the cutwater and an insert having opposed end portions receivable within respective recesses.

In some embodiments, the insert is formed from plastics, ceramic, or metallic material.

In a second aspect, embodiments are disclosed of a pump liner for a centrifugal pump comprising two side parts which can be fitted together so that the pump liner comprises a main pumping chamber, an inlet to the main pumping chamber and a discharge outlet extending from the main pumping chamber, said main pumping chamber and said discharge outlet each having an inner peripheral surface, a transition portion having a transition surface between the inner peripheral surfaces of said pumping chamber and said discharge outlet, said transition portion including a cutwater wherein each of said side parts comprises a part of the main pumping chamber, the discharge outlet and the transition portion and wherein each part of said transition portion having reinforcement associated therewith.

The reinforcement reduces the effect of flow, vibration and pressure effects on the wear on the rubber liner, especially at the region of the cutwater. The reinforcement can also reduce the risk of breakage or fracture of a portion of the cutwater.

In some embodiments, the reinforcement includes a projection on one of the parts of the transition portion and a co-operating recess on the other of the parts of the transition portion, the projection being receivable within the recess when the side parts are fitted together.

In some embodiments, the cutwater includes a leading edge, said reinforcement in the transition portion being spaced from the leading edge of the cutwater.

In some embodiments, the projection extends into the recess when fitted sufficiently to account for any wear of the liner when in use. In some embodiments, the reinforcement is spaced from the inner peripheral surface of the pumping chamber and discharge outlet.

In some embodiments, the recess and said projection are generally rectangular when viewed in cross-section having a longitudinal axis extending in the direction of the cutwater.

In some embodiments, the reinforcement includes a recess in each part of the transition portion and an insert having opposed end portions receivable within respective recesses.

In some embodiments, the insert is formed from plastics, ceramic, or metallic material.

In a third aspect, embodiments are disclosed of a centrifugal pump comprising a pump casing as described above in any one of the preceding embodiments with a main chamber therein, an inlet opening and a discharge outlet, an impeller disposed within the main chamber and mounted for rotation on an impeller shaft.

In some embodiments, the pump casing is in the form of a liner disposed within an outer casing.

In a fourth aspect, embodiments are disclosed of a method of fitting a liner within a pump as described above wherein the liner is fitted within the main chamber.

BRIEF DESCRIPTION OF THE DRAWINGS

Notwithstanding any other forms which may fall within the scope of the apparatus as set forth in the Summary, specific embodiments will now be described, by way of example, and with reference to the accompanying drawings in which:

FIG. 11 illustrates some experimental computational simulation results for fluid flow in the plane A-A shown in the embodiment of the impeller of FIG. 9, but where there is no cutwater protrusion in position;

FIG. 11A is the cross sectional view of an impeller and pump casing taken at a point downstream of the cutwater of a pump, generally equivalent to a plane formed through line A-A, as shown depicted in FIG. 9;

FIG. 12 illustrates some experimental computational simulation results for fluid flow in the plane A-A shown in the embodiment of the impeller of FIG. 9;

DETAILED DESCRIPTION OF THE SPECIFIC EMBODIMENTS

Figure 5:
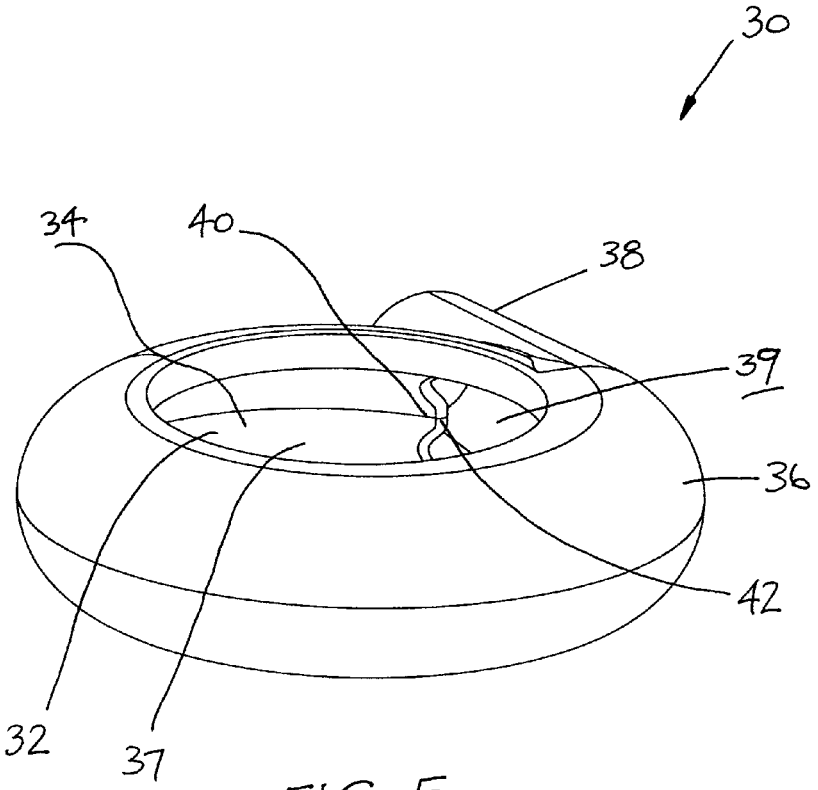
FIG. 5 is an exemplary perspective illustration of a centrifugal pump casing in accordance with one embodiment.
Figure 6:
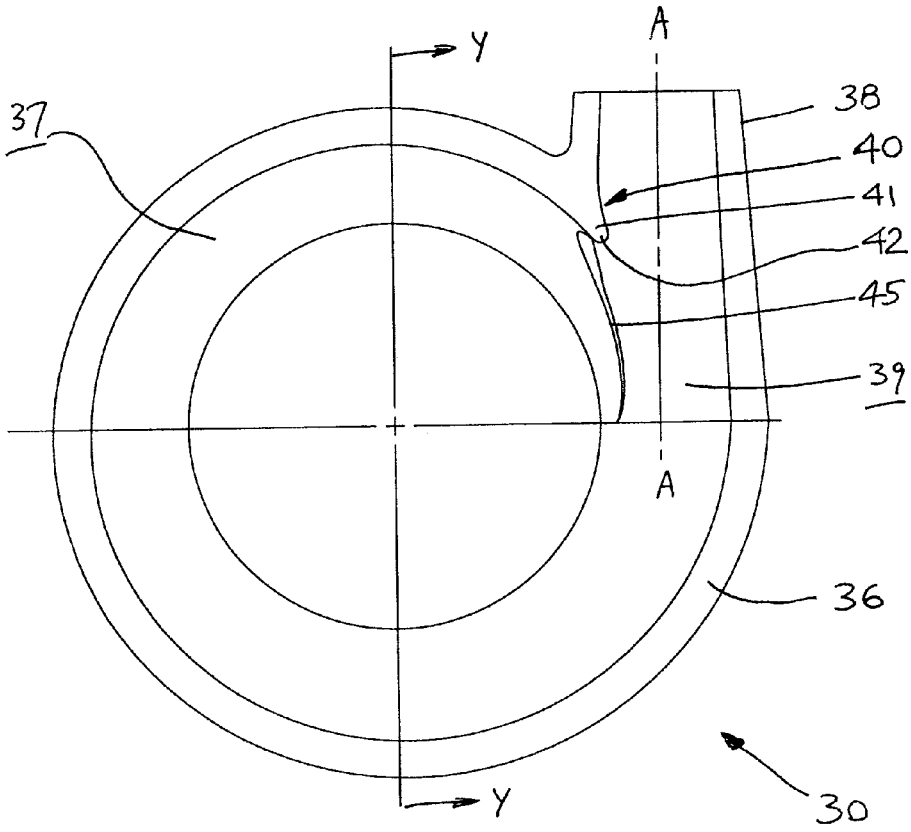
FIG. 6 illustrates a sectional side elevation of the pump casing shown in FIG. 5.
Figure 7:
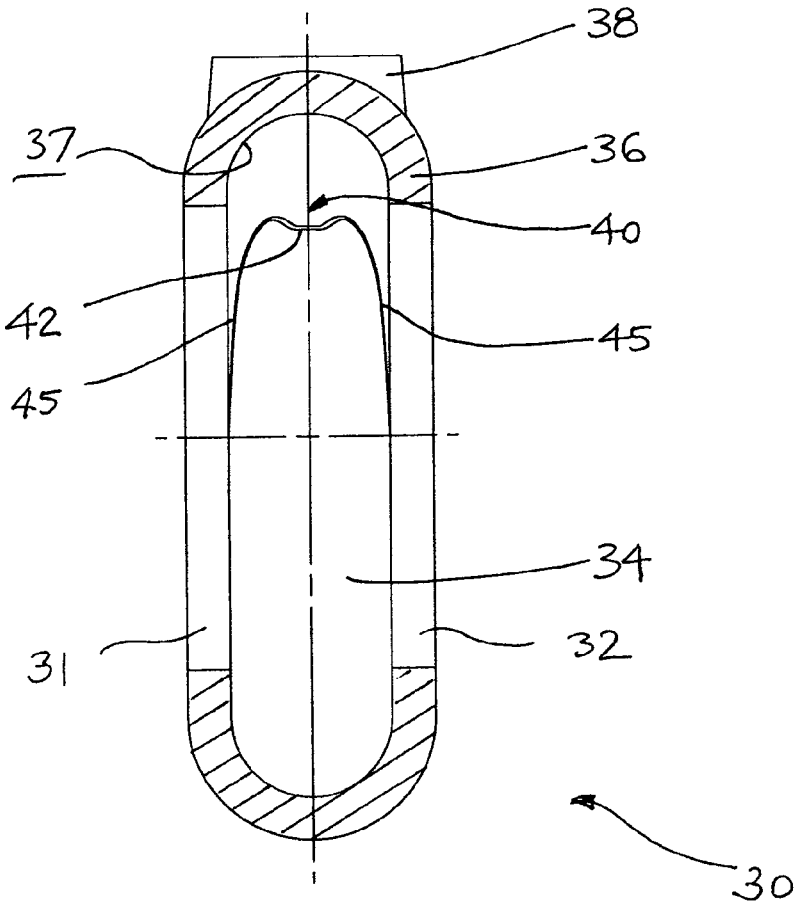
FIG. 7 illustrates a sectional view taken along the line Y-Y in FIG. 6.

Referring to FIGS. 5 to 7, an embodiment of a pump casing 30 is shown having a main pumping chamber 34 therein. The pump casing 30 is of a generally volute shape, similar to a car tire. In the embodiment shown, the pump casing 30 is in the form of a liner which, in use, is disposed within an exterior casing structure of a pump, and within which an impeller can be caused to rotate.

The pump casing 30 has generally circular openings 31 and 32 located in opposed sides thereof, one of which will provide for an inlet opening 32 for the introduction of a flow of material into the main pumping chamber 34. The other opening 31 provides for the introduction of a drive shaft (not shown) used for rotatably driving an impeller (not shown) which is disposed within the pumping chamber 34. The pump casing further includes a peripheral wall portion 36 having an inner peripheral surface 37 and a discharge outlet 38 which extends tangentially from the wall portion 36 (that is in the direction of line A-A in FIG. 6), the discharge outlet having an inner peripheral surface 39. The main pumping chamber 34 is generally of volute shape and, in the embodiment illustrated, at any point about its circumference is generally semicircular cross-section as shown in FIG. 7. In another embodiment shown in FIG. 10 and described shortly, the main pumping chamber 34 is generally of volute shape and, in the embodiment illustrated, at any point about its circumference is generally U-shaped in cross-section.

The pump casing 30 shown in FIGS. 5 to 7 further includes a transition surface or zone 40 which extends between the inner peripheral surface 37 of the main pumping chamber 34 and the inner peripheral surface 39 of the discharge outlet 38. The transition surface or zone provides for a transition between the pathway flowing through the spiral or circumferential length of the pumping chamber 30 and the discharge of fluid through the discharge outlet 38. The transition surface or zone 40 includes a cutwater 41 and two blend or transition regions (or merging regions) 45 that are arranged to extend between the cutwater 41 and the respective inner peripheral surfaces 37, 39 of the main pumping chamber 34 and the discharge outlet 38. The cutwater 41 has a generally rounded surface form, having a protrusion or projection extending therefrom. As illustrated in FIGS. 5 and 7, the protrusion or projection is in the form of a prominent bump, bulge or dimple 42 being centrally disposed between the side walls of the main pumping chamber when viewed in end cross-section. The bump or dimple 42 extends irregularly as part of the otherwise arched or smooth cutwater 41, but has generally rounded edges. In other forms, the protrusion can be tongue-like, or even pointed in shape.

The transition surface or zone 40 (including cutwater 41 with bulge 42 and transition regions 45) is adapted to separate the in use flow of slurry material moving through the discharge outlet 38 from the recirculating flow of material within the main pumping chamber 34. The cutwater 41 is arranged to distribute the flow into the discharge outlet 38 and reduce the recirculation flow of material in the main pumping chamber 34. It is believed that the cutwater protrusion or projection and the blend or transition regions can reduce the amount of vortex flow that develops on either side of the volute and also reduce the level of vortex flow, which together reduces the amount of turbulence in the cutwater region. Lower velocity and less curving can result in less erosive wear of the pump components which are in contact with moving mineral slurry.

In the embodiment shown in FIGS. 5 to 7, and referring especially to FIG. 6, the cutwater 41 extends partially into the discharge outlet 38, which has been found to be an advantageous arrangement.

The cutwater protrusion or projection also is believed to reduce the potential for two vortex patterns to develop simultaneously on either side of the volute during use pumping a fluid or fluid-solid mixture. Smoother and less turbulent flow in the cutwater region tends to favour only one dominant vortex pattern developing, but having a lower intensity. Wear and erosion due to one weaker vortex will produce less wear and hence longer component life. Lower vortex and turbulence levels in the volute cutwater region can also improve the pump performance and efficiency over a wider range of flow operating conditions.

Figure 8:
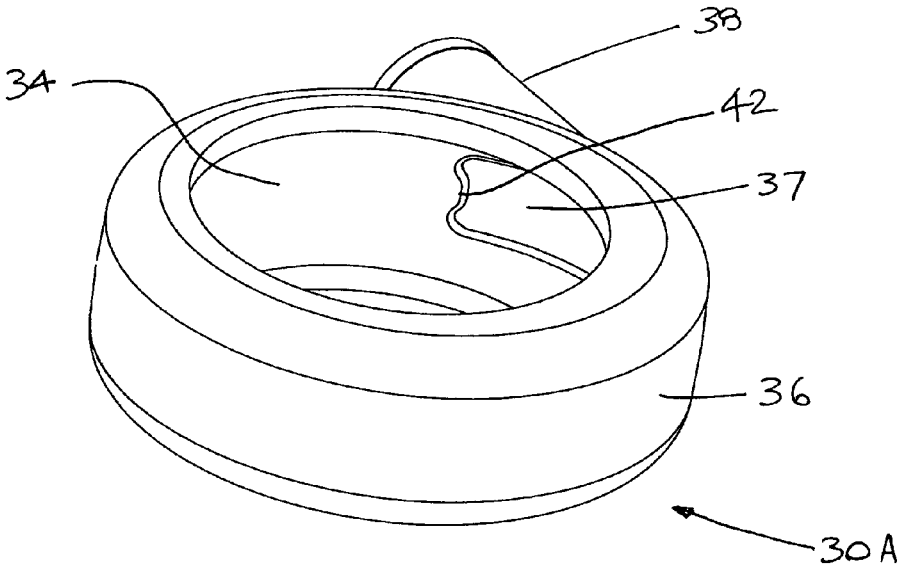
FIG. 8 is an exemplary perspective illustration of a pump casing in accordance with another embodiment.
Figure 9:
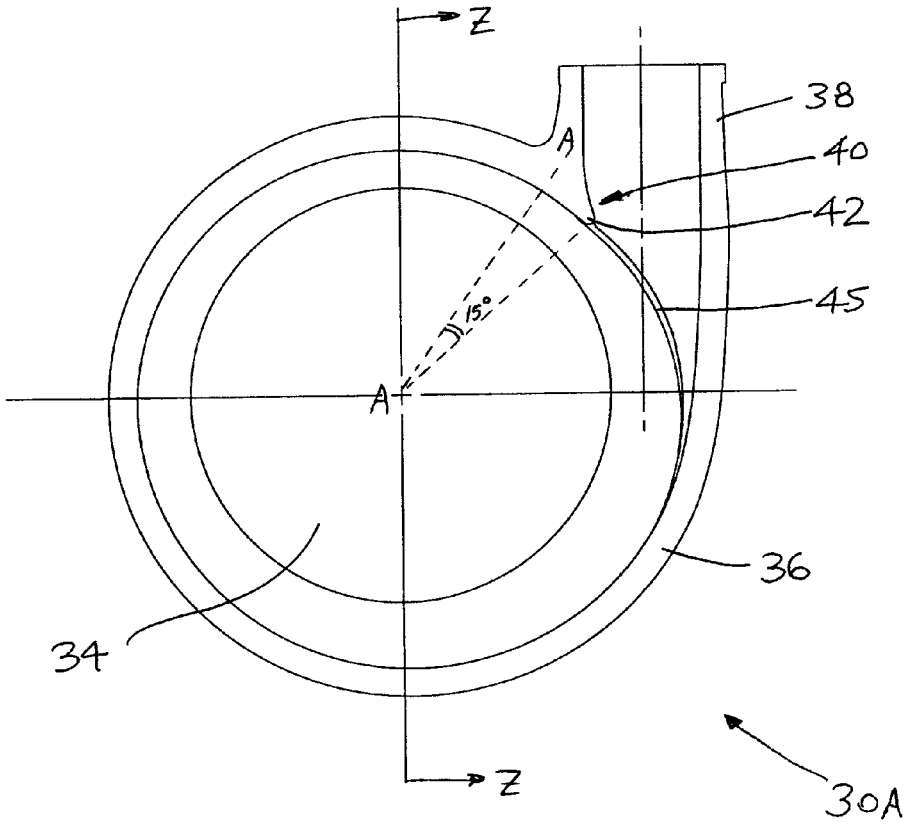
FIG. 9 illustrates a sectional side elevation of the pump casing shown in FIG. 8.
Figure 10:
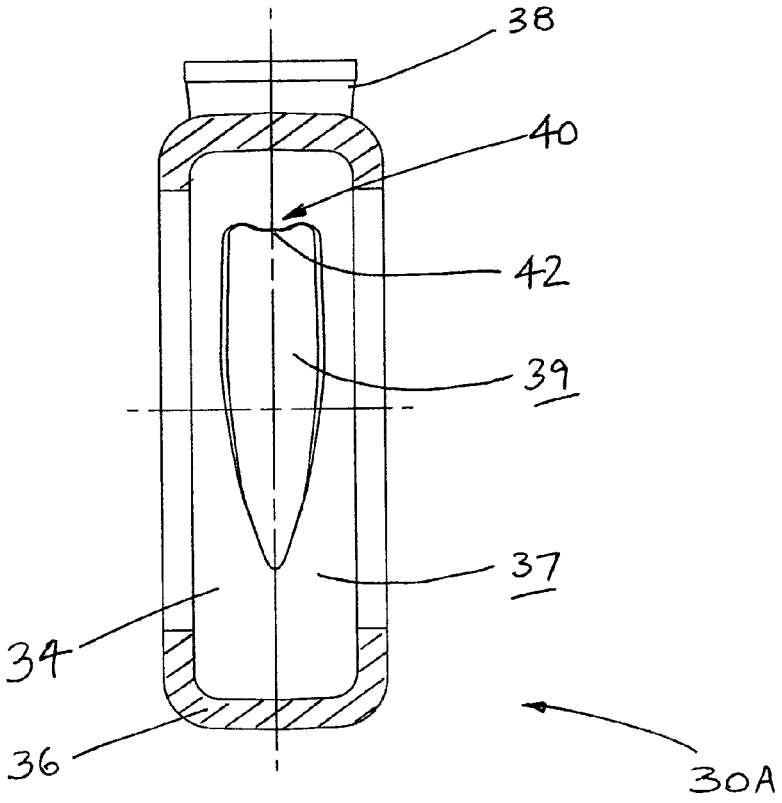
FIG. 10 illustrates a sectional view taken along the line Z-Z in FIG. 9.

Referring to FIGS. 8 to 10, a further embodiment of a pump casing 30A is shown having a main pumping chamber 34 therein. The pump casing 30A is of a generally volute shape, similar to a car tire. In the embodiment shown, the pump casing 30A is in the form of a liner which, in use, is disposed within an exterior casing structure of a pump, and within which an impeller can be caused to rotate. As mentioned earlier, the main pumping chamber 34 is generally of volute shape and, in the embodiment illustrated, at any point about its circumference is generally U-shaped in cross-section. For convenience the same reference numerals have been used to identify like features in FIGS. 5 to 7 and in FIGS. 8 to 10.

The cutwater itself and/or the protrusion or projection extending from the cutwater can be made of any material suitable for being shaped, formed or fitted as described, such as an elastomeric material; or hard metals that are high in chromium content or metals that have been treated (for example, tempered) in such a way to include a hardened metal microstructure; or a hard-wearing ceramic material, which can provide suitable wear resistance characteristics when exposed to a flow of particulate materials.

In some embodiments the protrusion or projection can be retrofitted to the transition surface 40 of a prior art pump casing to form the profiled section, by the use of any appropriate fixing or joining technique, for example by pinning, welding, adhesive cement bonding. In some circumstances, it is be possible to remove and retrofit a worn protrusion from its position on the cutwater after a period of use or, for example, if part of the protrusion has broken off during use. Depending on the material of manufacture, the protrusion can be repaired by the same forming techniques as described above.

The materials used for the pump casings disclosed herein may be selected from materials that are suitable for shaping, forming or fitting as described, including hard metals that are high in chromium content or metals that have been treated (for example, tempered) in such a way to include a hardened metal microstructure. The casings could also be manufactured from other hard-wearing materials such as ceramics, or even made of hard rubber material if the casing functions as a volute liner in a pump.

Any of the embodiments of casings disclosed herein find use in a centrifugal slurry pump of the volute type. Such pumps normally comprising a pump casing having an inlet region and a discharge region, and an impeller is positioned within the pump casing and is rotated therein by a motorised drive shaft which is axially connected to the impeller. Since the volute liner is normally a wearing part, then periodically the pump exterior casing structure is opened and the worn volute liner is removed and discarded and is replaced by an unworn volute liner of the type disclosed herein. The worn volute liner can be of a different design to the new, unworn volute liner provided that the new, unworn volute liner is interchangeable with the space within the pump exterior casing to allow retrofitting.

In some embodiments the casing is a cast product made of solidified molten metal. The casting process involves pouring the molten metal into a mould and allowing the metal to cool and solidify to form the required shape. The complexity of the casting process depends to some extent on the shape and configuration of the casing mould, in some cases necessitating special techniques for introducing the molten metal and for detaching the cast product from the mould.

Experimental Simulation

Computational experiments were carried out to simulate flow in the various designs of pump casing disclosed herein, using commercial software ANSYS CFX. This software applies Computational Fluid Dynamics (CFD) methods to solve the velocity field for the fluid being pumped. The software is capable of solving many other variables of interest, however velocity is the variable which is relevant for the figures shown herein.

For each CFD experiment, the results are post-processed using the corresponding module of CFX. FIG. 11 (Experiment 1) shows cross-sectional views of a plane A-A which cuts the conventional pump casing in a radial plane positioned 15 angle degrees downstream of the cutwater on the pump casing of the type that is shown in FIG. 9 but where there is no cutwater protrusion formed thereat. FIG. 12 (Experiment 2) shows cross-sectional views of a plane A-A which cuts an embodiment of pump casing with a cutwater protrusion in a radial plane positioned 15 angle degrees downstream of the cutwater on the pump casing which is shown in FIG. 9, and which does feature a cutwater which includes a protrusion. The velocity vectors are plotted on these planes to analyse how the fluid and slurry particles move through the channel formed between two opposing (front and back) impeller shrouds and enter into an annular space within the pump casing where the pump casing is U-shaped in cross-section. The size of these vectors together with their distribution density indicates the magnitude of the velocity parameter, and curved vector patterns generally indicate the presence of vortices.

Experiment 1

In the side view of the flow shown in FIG. 11, the distribution density of the vectors indicates the magnitude of velocity parameter and the presence of vortices. The important area to look at is the region located at the uppermost edge of each drawing, which is where the fluid contacts the interior surface of the pump casing. The density of the arrows can be noted. The relevant area is indicated by the arrow marked G in each velocity vector plot. There is also a great deal of turbulent flow exiting the region between the impeller shrouds, as indicated by the arrow marked H.

Experiment 2

Figure 1:
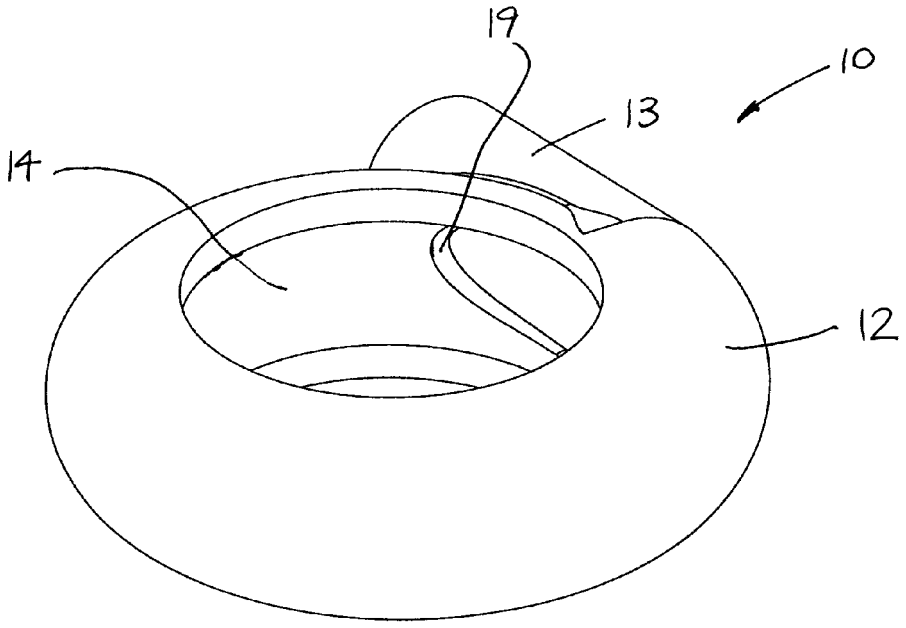
FIG. 1 (PRIOR ART)
FIGS. 1 and 2 are perspective illustrations of a conventional pump casing discussed earlier.
Figure 2:
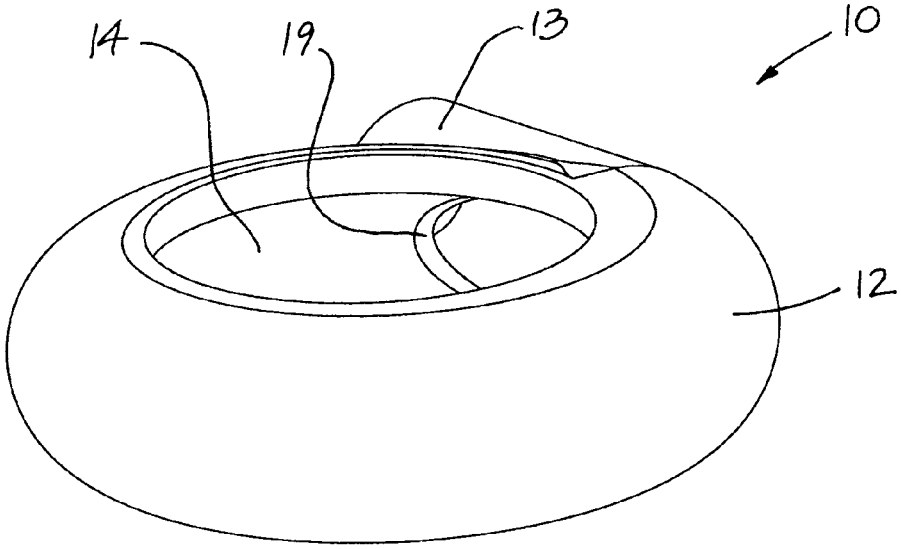
FIG. 2 (PRIOR ART)
Figure 3:
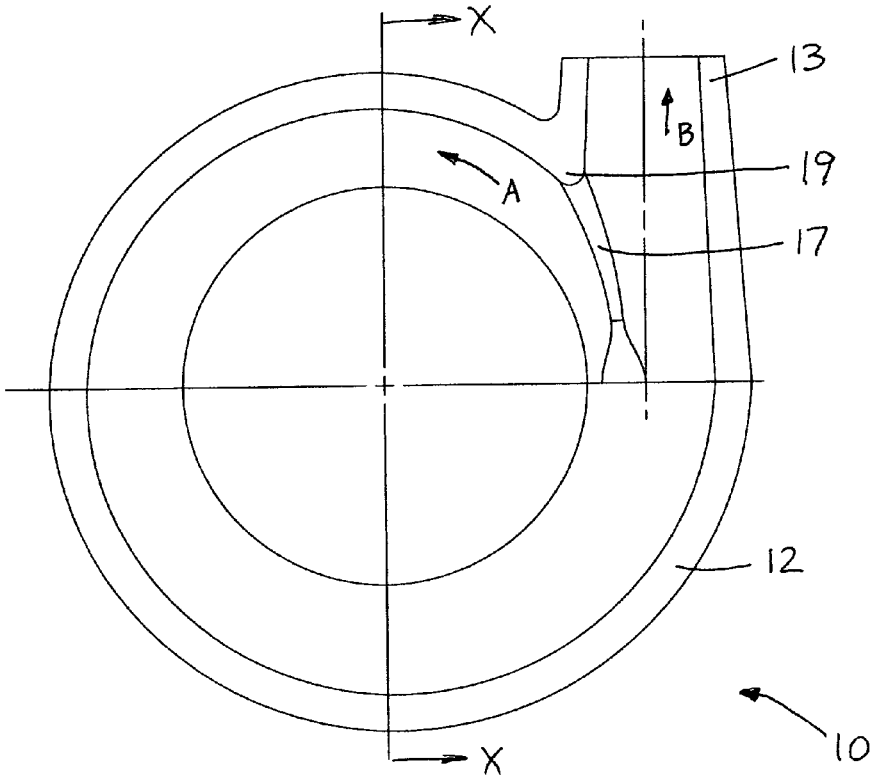
FIG. 3 (PRIOR ART)
FIG. 3 illustrates a sectional side elevation of the pump casing shown in FIGS. 1 and 2.
Figure 4:
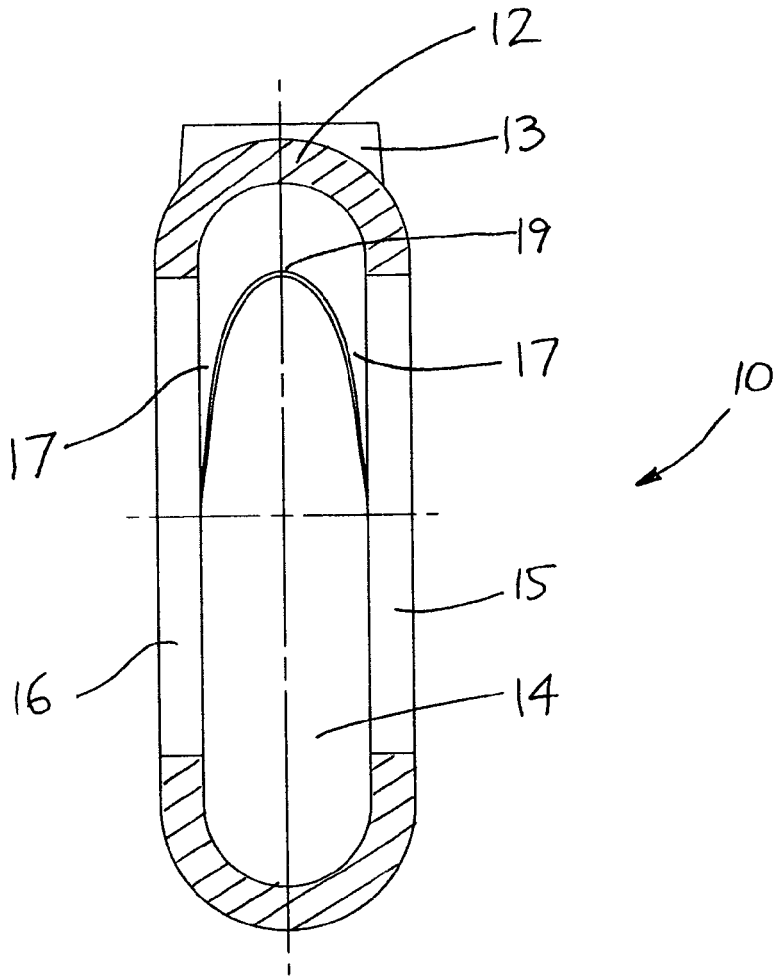
FIG. 4 (PRIOR ART)
FIG. 4 illustrates a sectional view taken along the line X-X in FIG. 3.

In the side view of the flow shown in FIG. 12, the distribution density of the vectors at the region located at the uppermost edge of each drawing, which is where the fluid contacts the interior surface of the pump casing, is less than that shown in FIG. 11 (Experiment 1). The relevant area in FIG. 12 is indicated in the velocity vector plot by the small arrow marked J. This means that there will be less vortices (and thus less wear) at the inner surface face of the pump casing shown in FIG. 9 compared with the conventional type shown in FIG. 3 which does not have the cutwater protrusion. There is also much less turbulent flow exiting the region between the impeller shrouds, as indicated by the arrow marked K, when compared with the region marked by arrow H in FIG. 11 for the conventional casing.

Figure 13:
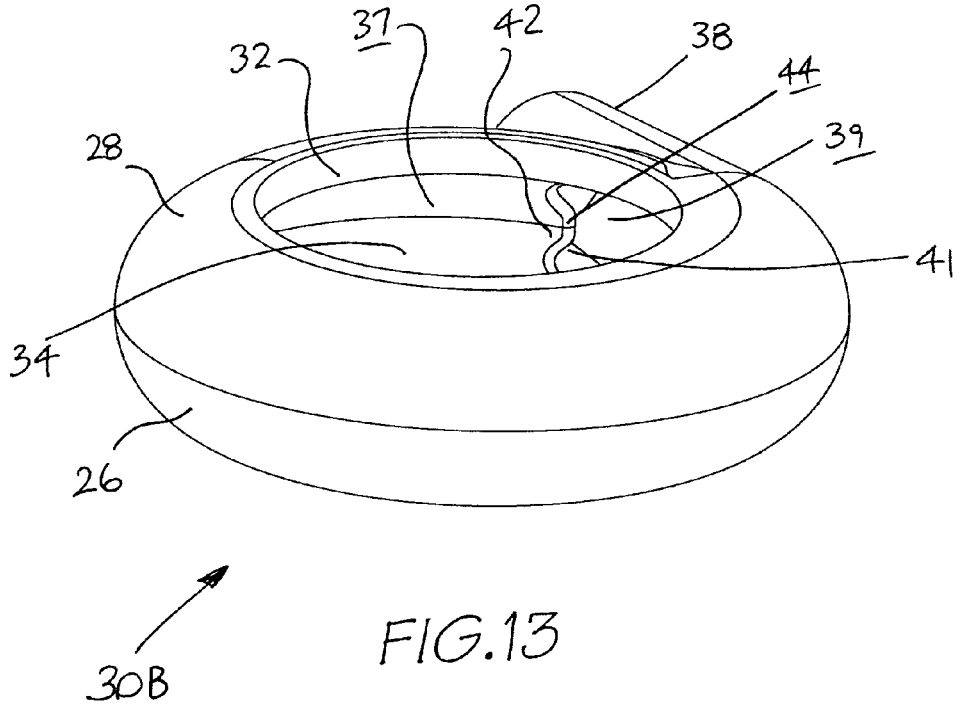
FIG. 13 illustrates a further exemplary perspective view of a pump liner.
Figure 14:
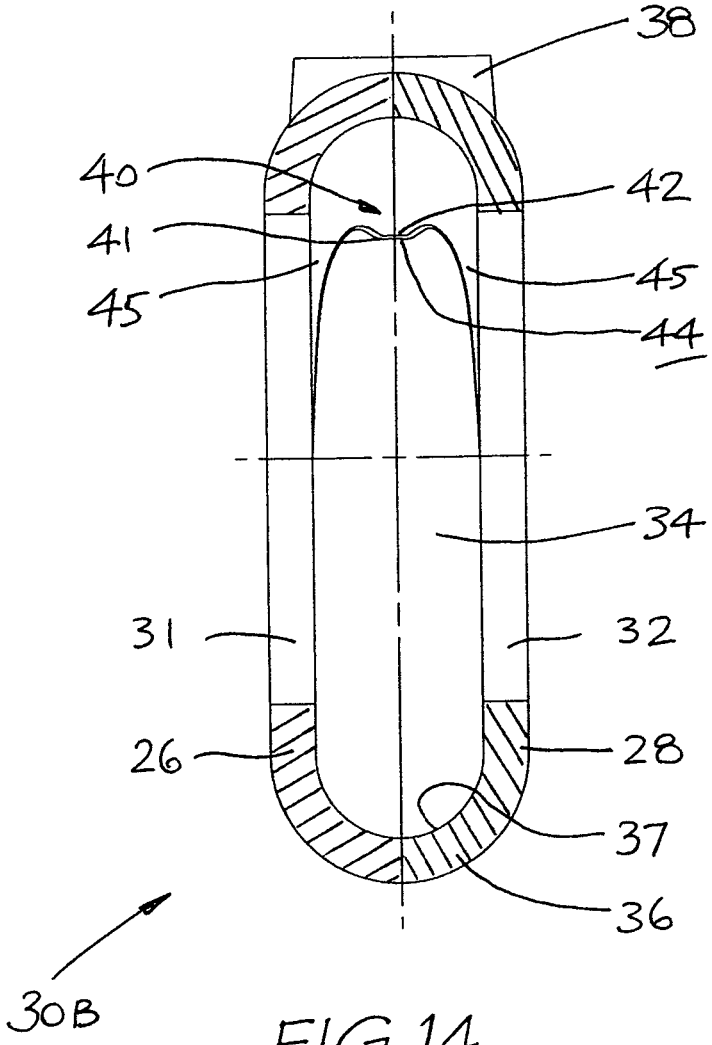
FIG. 14 illustrates a sectional view of the pump liner shown in FIG. 11.
Figure 15:
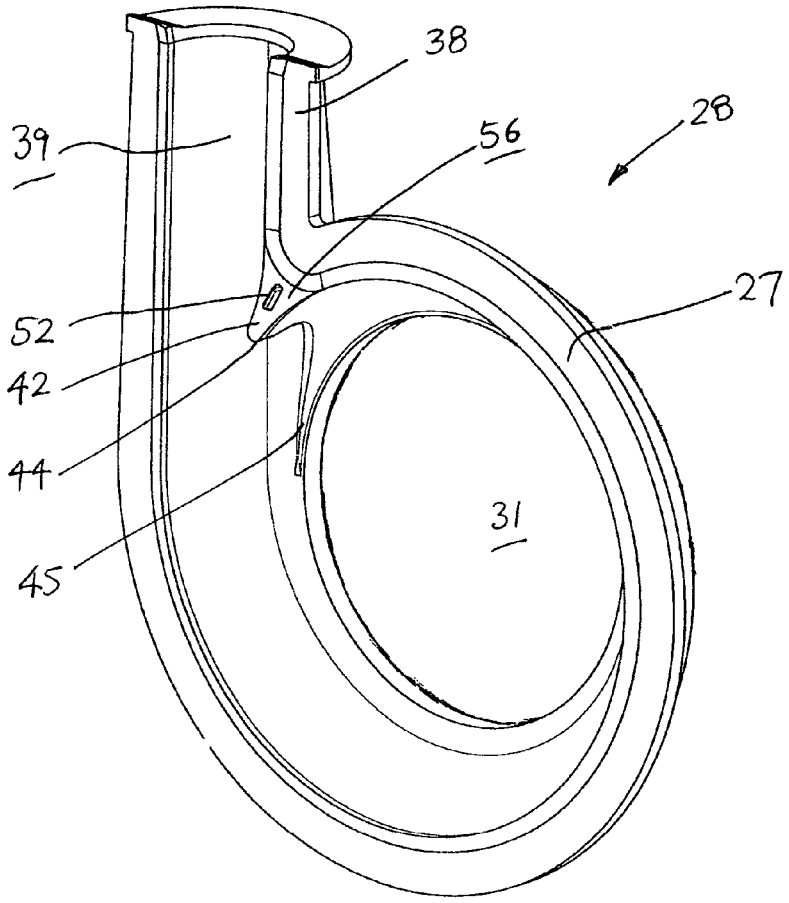
FIG. 15 illustrates a perspective view of one of a pair of liner parts according to one embodiment.
Figure 16:
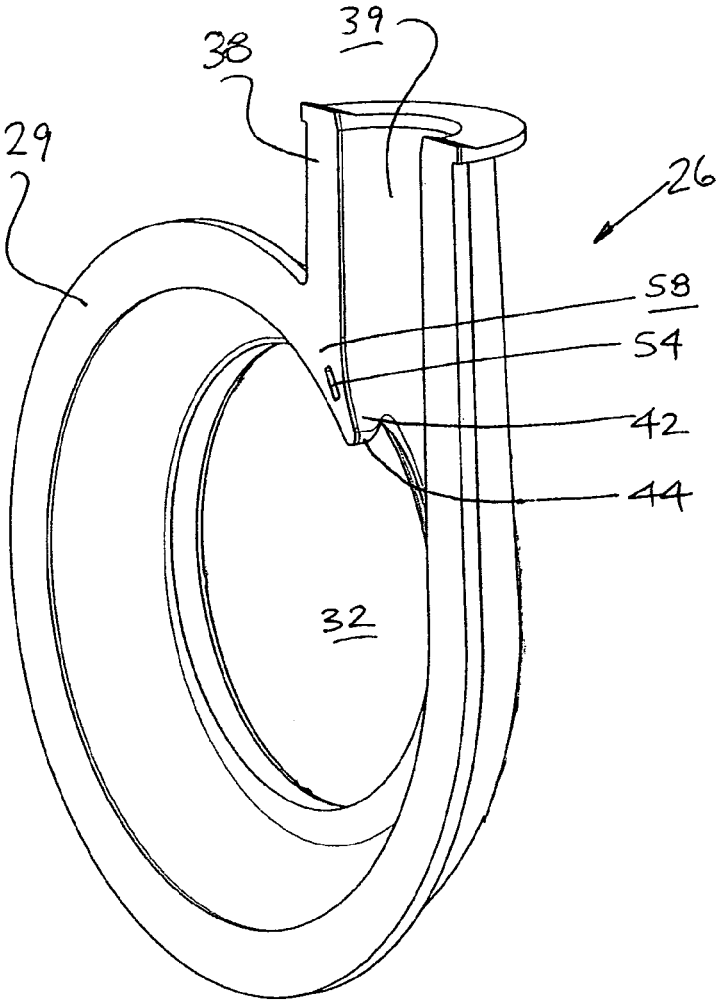
FIG. 16 illustrates a perspective view of the other of a pair of liner parts according to one embodiment.
Figure 17:
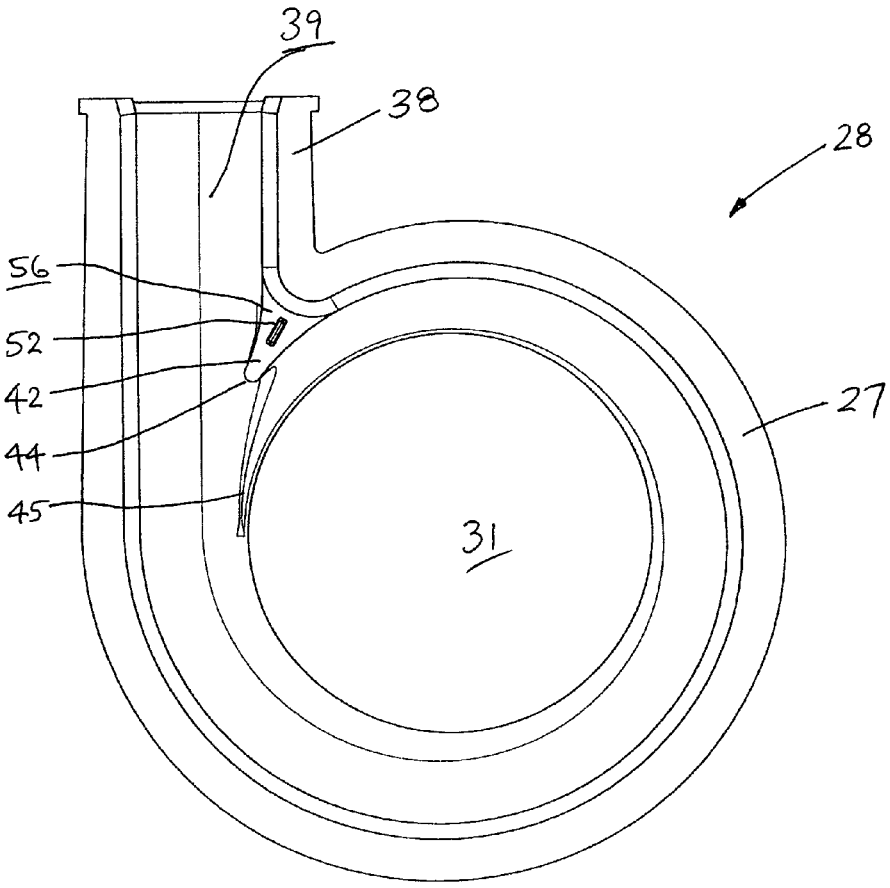
FIG. 17 illustrates a side elevation view of the part shown in FIG. 13.
Figure 18:
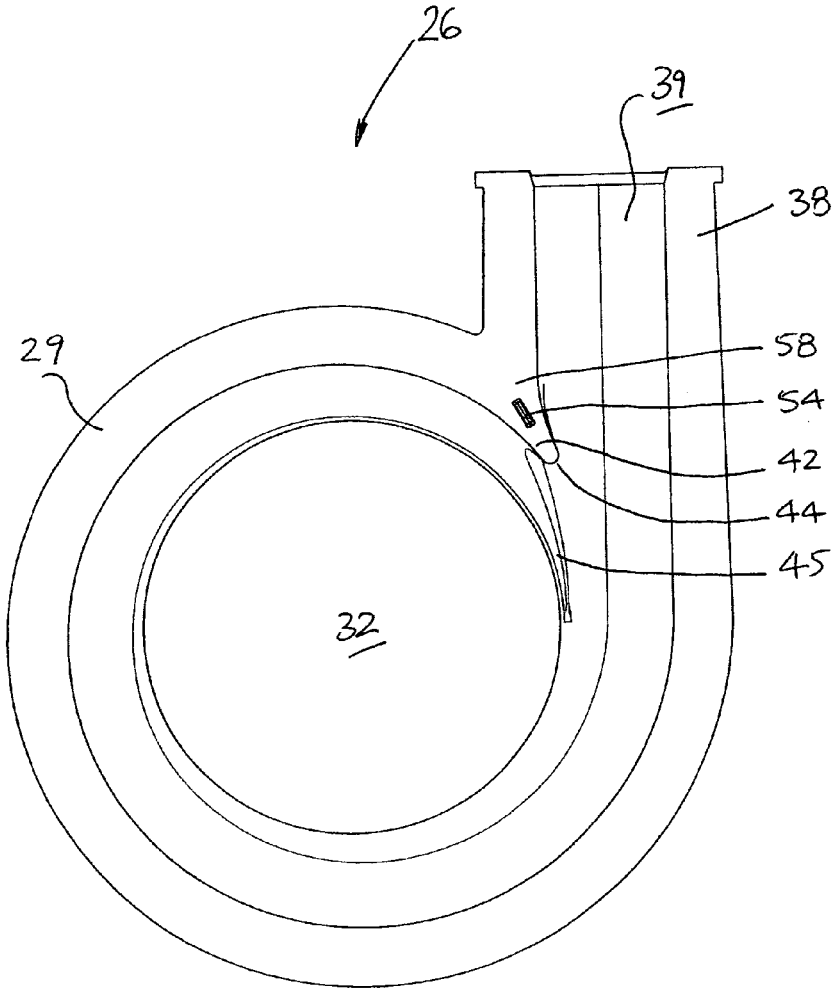
FIG. 18 illustrates a side elevation view of the part shown in FIG. 14.

Referring now to FIGS. 13 and 14, there is shown a pump liner 30B which includes two opposed side parts 26 and 28 which can be fitted together at the peripheral edges 27 and 29. The pump liner 30B is formed of elastomeric material and is adapted to be encased within an outer rigid pump casing. For convenience the same reference numerals have been used to identify like features in FIGS. 13 to 18 as in the earlier FIGS. 5 to 10.

The pump liner 30B has a main pumping chamber 34 located therein, and has openings 31 and 32 in opposed sides thereof, one of which will provide for an inlet opening 31 for the introduction of a flow of material into the main pumping chamber 34. The other opening 32 provides for the introduction of a drive shaft (not shown) used for rotatably driving an impeller (not shown) which is disposed within the pumping chamber 34. The pump liner further includes a peripheral wall portion 36 having an inner peripheral surface 37 and a discharge outlet 38 having an inner peripheral surface 39. The main pumping chamber 34 is generally of volute shape.

The pump liner 30B further includes a transition surface or zone 40 which extends between the inner peripheral surface 37 of the main pumping chamber 34 and the inner peripheral surface 39 of the discharge outlet 38. The transition surface or zone 40 includes a cutwater 41 and two blend or transition (or merging regions) 45 that are arranged to extend between the cutwater 41 and the respective inner peripheral surfaces 37, 39 of the main pumping chamber 34 and the discharge outlet 38. The cutwater 41 has a generally rounded surface form with a leading or free edge 44, having a protrusion or projection extending therefrom. The free or leading edge is in proximity to which the impeller passes when the impeller rotates within the pumping chamber. As illustrated in FIGS. 13 and 14, the protrusion is in the form of a prominent bump, bulge or dimple 42 being centrally disposed between the side walls of the main pumping chamber when viewed in end cross-section. The bump, bulge or dimple 42 extends irregularly as part of the otherwise arched or smooth cutwater 41 but has generally rounded edges.

The transition surface or zone 40 is adapted to separate the in use flow of slurry material moving through the discharge outlet 38 from the recirculating flow of material within the main pumping chamber 34. The cutwater 41 is arranged to distribute the flow into the discharge outlet 38 and reduce the recirculation flow of material in the main pumping chamber 34.

As illustrated in FIGS. 15 to 18 a reinforcement 50 is provided in the region of the cutwater 41 and as shown includes a protrusion 52 on the face 56 on one of the parts of the transition portion and a co-operating recess 54 on the face 58 of the other of the parts of the transition portion, the projection being receivable within the recess when the side parts are fitted together. In another form, a recess is provided on each of the parts of the transition portion and an insert (such as a dowel or the like) is receivable in each recess when the side parts are fitted together. The reinforcement in the transition portion is spaced from the leading edge of the cutwater 41. The insert can be formed from plastics, ceramic or metal material. The protrusion or recess extends into the recess when fitted so that its free end is spaced from the outer surface of the part of the transition portion. In all forms, the reinforcement is spaced from the inner peripheral surfaces 37, 39 of the pumping chamber 34 and discharge outlet 38. The recess and said protrusion are generally rectangular when viewed in cross-section having a longitudinal axis extending in the direction of the cutwater.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "above" and "below" and the like are used as words of convenience to provide reference points and are not to be construed as limiting terms.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Finally, it is to be understood that various alterations, modifications and/or additional may be incorporated into the various constructions and arrangements of parts without departing from the spirit or ambit of the invention.

The invention claimed is:

1. A pump liner for a centrifugal pump comprising two side parts which can be fitted together so that the pump liner comprises a main pumping chamber, an inlet to the main pumping chamber and a discharge outlet extending from the main pumping chamber, said main pumping chamber and said discharge outlet each having an inner peripheral surface, a transition portion having a transition surface between the inner peripheral surfaces of said pumping chamber and said discharge outlet, said transition portion including a cutwater wherein each of said side parts comprises a part of the main pumping chamber, the discharge outlet and the transition portion and wherein each part of said transition portion has reinforcement associated therewith.

2. The pump liner according to claim 1 wherein said reinforcement includes a projection on one of the parts of the transition portion and a co-operating recess on the other of the parts of the transition portion, the projection being receivable within the recess when the side parts are fitted together.

3. The pump liner according to claim 2 wherein the projection extends into the recess when fitted sufficiently to account for any wear of the liner when in use.

4. The pump liner according to claim 2 wherein said recess and said projection are generally rectangular when viewed in cross-section having a longitudinal axis extending in the direction of the cutwater.

5. The pump liner according to claim 1 wherein said cutwater includes a leading edge, said reinforcement in the transition portion being spaced from the leading edge of the cutwater.

6. The pump liner according to claim 1, wherein the reinforcement is spaced from the inner peripheral surface of the pumping chamber and discharge outlet.

7. The pump liner according to claim 1 wherein said reinforcement includes a recess in each part of the transition portion and an insert having opposed end portions receivable within respective recesses.

* * * * *